US007107920B2

(12) United States Patent
Mataya

(10) Patent No.: US 7,107,920 B2
(45) Date of Patent: Sep. 19, 2006

(54) INSERT FOR FORMING A STERN DRIVE PASSAGEWAY IN A WATERCRAFT

(75) Inventor: Robert F. Mataya, Nixa, MO (US)

(73) Assignee: Tracker Marine, L.L.C., Springfield, MO (US)

( * ) Notice: Subject to any disclaimer, the term of this patent is extended or adjusted under 35 U.S.C. 154(b) by 0 days.

(21) Appl. No.: 10/821,140

(22) Filed: Apr. 7, 2004

(65) Prior Publication Data

US 2005/0223963 A1 Oct. 13, 2005

(51) Int. Cl.
*B63B 3/00* (2006.01)

(52) U.S. Cl. ..... 114/65 R; 425/470

(58) Field of Classification Search ..... 114/65 R, 114/69, 343, 357; 264/258, 338; 425/470
See application file for complete search history.

(56) References Cited

U.S. PATENT DOCUMENTS 2,617,126 A * 11/1952 Nebesar ..... 114/357
3,503,583 A * 3/1970 Emerson et al. ..... 425/470
3,638,299 A * 2/1972 Garner et al. ..... 264/338
3,840,319 A * 10/1974 Rhoda ..... 425/470
5,601,049 A * 2/1997 Hordis et al. ..... 114/357

* cited by examiner

*Primary Examiner*—Lars A. Olson
(74) *Attorney, Agent, or Firm*—Blackwell Sanders Peper Martin, LLP

(57) ABSTRACT

An insert for use in the fabrication of a watercraft hull to form an inboard/outboard propulsion system passageway. The design of the insert incorporates a semi-rigid body having an inboard surface, an outboard surface, and side-walls interconnecting the surfaces. The semi-rigid nature of the body facilitates the insert fitting tightly with the build up of laminate layers forming a watercraft hull while maintain dimensional stability during the manufacture of the hull. The insert is further configured to be easily removed from the completed watercraft hull to reveal the finished inboard/outboard propulsion system passageway.

19 Claims, 3 Drawing Sheets

INSERT FOR FORMING A STERN DRIVE PASSAGEWAY IN A WATERCRAFT

CROSS-REFERENCE TO RELATED APPLICATIONS

None.

STATEMENT REGARDING FEDERALLY SPONSORED RESEARCH OR DEVELOPMENT

Not applicable.

BACKGROUND OF THE INVENTION

Conventional watercraft, such as recreational powerboats and the like, often generate movement using an inboard/outboard (I/O) propulsion system. These I/O propulsion systems incorporate a stern drive component that typically includes a motor (e.g., a combustion engine), tilt components (e.g., gimbal unit and pivot housing) and an outdrive having a propeller. An opening or passageway is formed in the transom of the watercraft hull so that the stern drive component may be extended therethrough and mounted with the watercraft.

Complicating the formation of the transom opening is the typical lay-up that forms the watercraft hull. This lay-up includes a number of laminate layers, such as a glass reinforced resin shell and various core materials including plywood, glass reinforced cast composites, and other materials. Cutting and/or drilling through these types of laminate layers to form the transom opening has proven to be quite difficult and time consuming with traditional hand tools; an accurately formed transom opening is therefore hard to achieve. A more precise transom opening outline may sometimes be realized by using automated cutting equipment, but this equipment is often cost prohibitive and requires substantial training to use properly.

One proposed solution is to form the transom opening by using a reusable cast metal insert, such as one made of aluminum. In this method, the insert is shaped to form the transom opening as a watercraft hull is molded around the perimeter of the insert. In a first step, the insert is attached to a molding tool such that one face of the insert faces inboard and an opposing face of the insert faces outboard with respect to the watercraft hull being formed thereon. Then, a shell layer of the hull is molded onto the molding tool and surrounding the perimeter of the insert. It would seem intuitive at this point just to build the remaining laminate layers onto the shell layer around the insert perimeter, detach the insert from the molding tool, and demold the laminate layers forming the finished watercraft hull from the molding tool (and the insert from the hull) to reveal the transom opening in the hull. However, the rigidity of the metal insert does not promote a tight fit between the insert and the molding tool surface. This allows gel coat or other coatings applied to the layer surfaces to promote lamination thereof to flow between the molding tool and the insert, thereby encapsulating the insert and making removal of the insert and hull from the tool without damaging the hull (and thus damaging the transom opening) very difficult. Also, the lack of a tight fit between the insert and the molding tool facilitates the formation of air voids when the coatings are applied, which impair the structural soundness of the hull and are difficult to remove.

To solve the problems associated with using the cast metal insert, a raised, curved surface made of clay or wax is formed onto the exposed perimeter of the insert once the insert is installed with the moldling tool. This forms a tighter seal between the insert and the molding tool surface such that the coatings do not pass to the lateral edges of the layers when building up the watercraft hull. Additionally, though, a release agent is usually required to be applied to the perimeter of the case metal insert to thereby form a release film, in order to prevent the laminate from sticking to the insert. Release agents, unfortunately, do not perform ideally when applied to an essentially rigid metal insert. Such agents often form a release film with air voids and damaged spots, resulting in the insert bonding to the molding tool surface and thereby impeding the removal of the insert to expose the finished transom opening.

BRIEF SUMMARY OF THE INVENTION

The present invention overcomes the problems of the prior art by providing an improved insert for use in the fabrication of a watercraft hull to form an inboard/outboard propulsion system passageway, or transom opening. The insert is formed of a semi-rigid body having an inboard surface, an outboard surface, and tapering perimeter sidewalls interconnecting the surfaces. The tapering of the sidewalls facilitates the removal of the insert from the built up layers forming the finished watercraft hull. To provide the semi-rigid body with the desired physical properties, the body may be formed from polyurea, polyurethane, a polyurea/polyurethane compound, or similar materials. Alternatively, the semi-rigid body can be formed of a hybrid structure with a central region formed of a more rigid material (e.g., a metal) and a perimeter region, including the sidewalls, formed of a less-rigid material.

Before fabrication of a watercraft hull using the insert can begin, a molding tool is manufactured to form the exterior shape of the watercraft hull and the insert is formed with a shape that will define the transom opening to be formed in the hull. In a first step of the process, a release agent is applied to a surface of the tool. The insert is then attached to the transom surface of the molding tool, and the insert and transom surface are coated with a gel that cures into a semi-rigid film that forms the outermost or "painted" surface of the watercraft hull. Subsequently, various layers of laminate material are applied in successive steps on top of one another and over the semi-rigid film (e.g., fiber material in a liquid resin matrix). To form the stiffening structure of the hull, various core layers (e.g., wood, foam, metal, and other materials) may be applied with the layers of laminate material to build the thickness and add strength to the laminate layers. Upon curing of the various laminate layers, the insert is detached from the molding tool transom surface and the finished watercraft hull and insert are demolded from the tool, preferably together. The insert may then be removed from the hull to reveal the transom opening in the hull.

Because of the semi-rigid nature of the materials forming the insert body—more specifically, the semi-rigid perimeter of the insert body which contacts the laminate layers of the watercraft hull—the insert facilitates an effective seal between the molding tool surface and the insert to prevent gel coat or other coatings from damaging the watercraft hull as the insert is being removed from the transom opening in the hull. The taper of the insert sidewalls also makes for easy insertion and removal of the insert, so that the insert may be reused over and over to form an accurately dimensioned transom opening. Furthermore, the design of the present invention obviates the need to use a release agent, further simplifying the watercraft hull fabrication process.

DETAILED DESCRIPTION OF THE INVENTION

Figure 1:
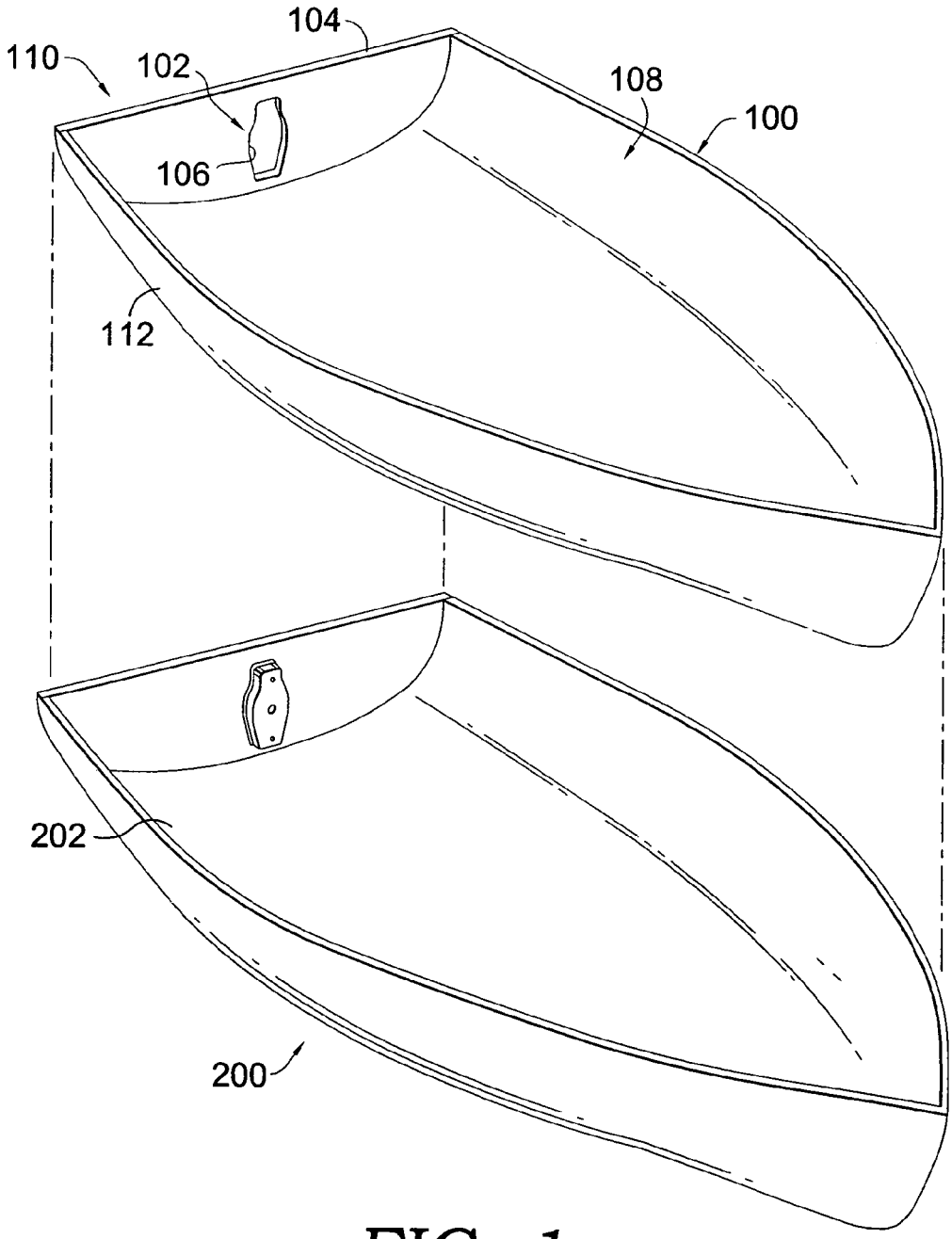
FIG. 1 is an exploded view showing a finished watercraft hull having a transom opening formed by an insert mounted with a molding tool.
Figure 2:
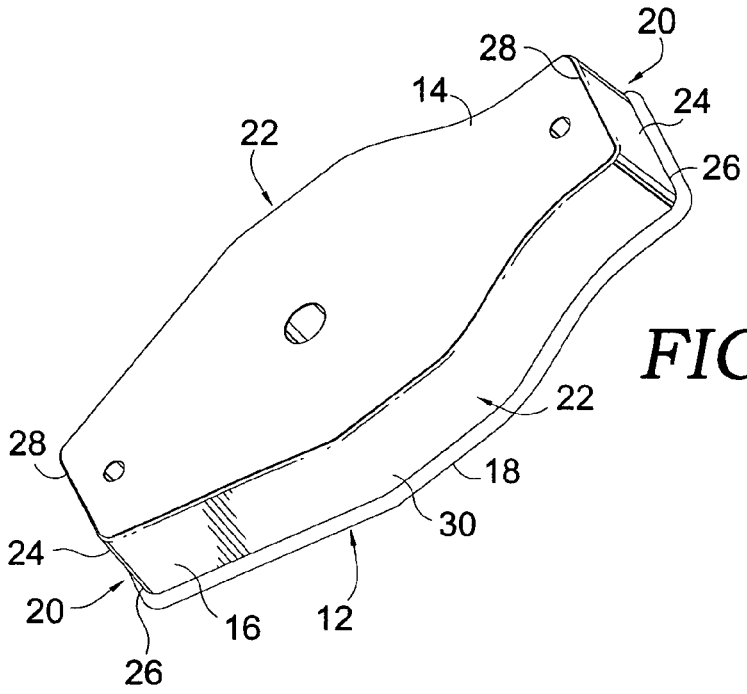
FIG. 2 is a perspective view of the insert of FIG. 1.
Figure 3:
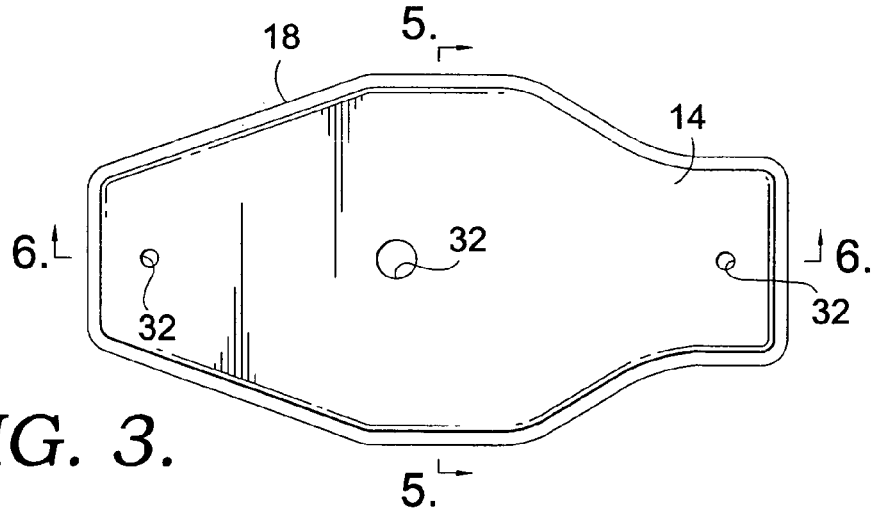
FIG. 3 is a top plan view of the insert of FIG. 1.
Figure 4:
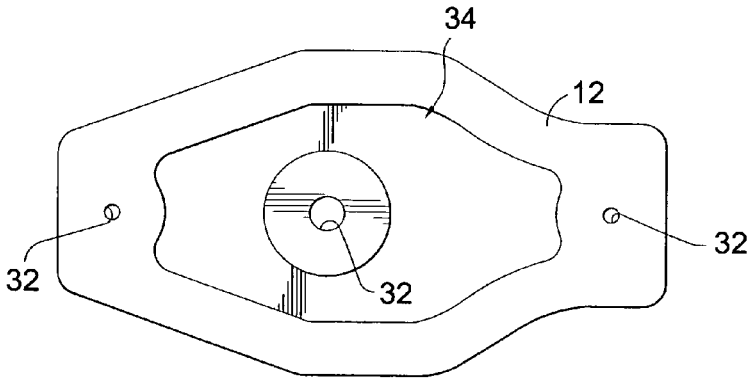
FIG. 4 is a bottom plan view of the insert of FIG. 1.

The present invention improves upon previous methods of forming transom openings in watercraft hulls through which stern drive components are mounted. This invention employs a reusable insert design comprised of a semi-rigid body around which the hull can be fabricated. The semi-rigid nature of the body allows for ease of removal of the insert from the finished watercraft hull with the built up laminate layers of the hull surrounding the perimeter of the insert. FIG. 1 shows the insert 10 mounted with molding tool 200 that forms the profile of a watercraft hull 100. The insert 10 is configured to define the shape of the inboard/outboard propulsion system passageway, in this case, an opening 102 in a transom 104 of the watercraft hull 100. As the laminate layers of the watercraft hull 100 are applied in successive steps onto a molding tool surface 202 of the tool 200, the insert extends through the layers in the shape of the transom opening 102. Upon curing of the laminate layers, the insert 10 is preferably detached from the molding tool 200, and then the insert 10 and finished watercraft hull 100 are simultaneously demolded from the tool. Finally, the insert 10 is removed from the hull 100 to reveal the finished transom opening 102.

Figure 5:
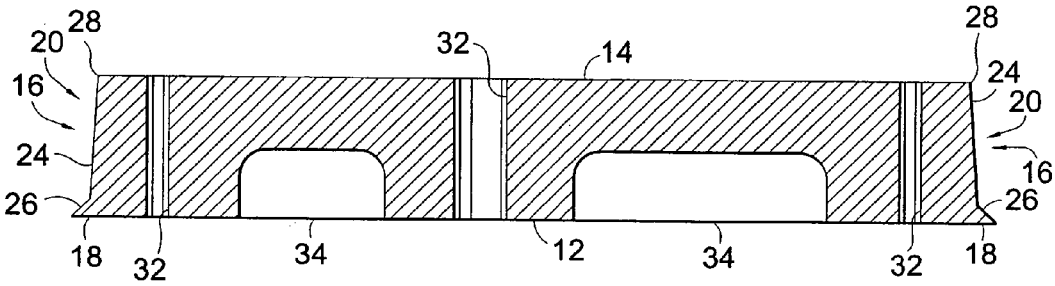
FIG. 5 is a cross-sectional view of the insert of FIG. 1 taken along line 5—5.
Figure 6:
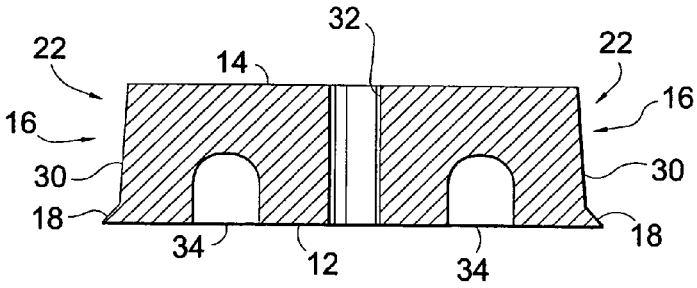
FIG. 6 is a cross-sectional view of the insert of FIG. 1 taken along line 6.

As seen in detail in FIGS. 2–6, the insert 10, or semi-rigid body, has a base or outboard surface 12, an inboard surface 14 and a sidewall 16 formed in a perimeter region 17 of the insert and spanning between the surfaces 12, 14. The sidewall 16 preferably has a slight taper in the direction moving from the outboard surface 12 to the inboard surface 14, as best seen in FIGS. 5–6. This taper increases the ease in removing the insert 10 from the hull 100 to reveal the transom opening 102. A perimeter lip 18 is also formed at the intersection of the outboard surface 12 and the sidewall 16 in the perimeter region 17 of the insert 10. When the insert 10 is attached to the molding tool 200 for watercraft hull fabrication, the perimeter lip 18 is flush against the molding tool surface 202. Thus, the combination of the perimeter lip 18 and the generally semi-rigid nature of the insert 10 facilitate the formation of a seal between the watercraft hull 100 and the insert. This seal impedes the flow of any coatings or laminates applied to the layers forming the watercraft hull 100 between the hull and the insert 10, which could prevent the hull from being damaged upon removal from the transom opening in the hull. Additionally, the seal provides the edges of the laminate layers with a contour that minimizes the formation of air voids that can otherwise create weak points in the hull and encourage bonding between the insert 10 and the molding tool surface 202.

The outlining shape of the insert defined by the sidewall 16 is dependent upon the desired shape of the transom opening 102 accommodating a stern drive component, as those of skill in the art will appreciate. The exemplary insert 10 shown in FIGS. 1–4 has a particular shape that yields a transom opening 102 that is particularly well suited for watercraft in the category of recreational power boats and the like. In the configuration shown, the sidewall 16 has a first set 20 of opposed tapered sections and a second set 22 of opposed tapered sections. The first set 20 comprises generally flat, planar walls 24 having base edges 26 adjoining the perimeter lip 18 and parallel with one another and upper edges 28 adjoining the inboard surface 14 and likewise parallel with one another. The second set 22 comprises planar walls 30 that interconnect the planar walls 24 of the first set 20. In a preferred arrangement facilitating optimal demolding of the insert 10 and watercraft hull 100, and subsequent removal of the insert 10 from the hull 100, the taper of the sidewalls 16 from the outboard surface 12 at the perimeter lip 18 to the inboard surface 14 allows for removal of the insert 10 in a direction from an inboard side 108 to an outboard side 100 of the hull 100.

The insert 10 also has a number of voids, preferably through-holes 32, such that a tool may be inserted therein to manipulate the position of the insert 10 with respect to the watercraft hull 100 and for mounting of the insert 10 with the molding tool surface 202. The through-holes 32 extend from the outboard surface 12 to the inboard surface 14. For example, a tool may have a protrusion that is inserted into one through-hole 32 and frictionally fits therewith, or if inserted on the inboard surface 12 side of the insert 10 clamps onto the outboard surface 14 of the insert. A centrally located cavity 34 is also formed in the insert outboard surface 12 to increase the flexibility of the semi-rigid body for insertion with and removal from the watercraft hull 100.

In one embodiment, the insert 10 is provided with the desired properties for use in watercraft hull fabrication by being formed of a semi-rigid body made from a somewhat pliable composite such as a polyurethane, a polyurea, a polyurethane/polyurea compound, or another substance that exhibits similar physical properties, including having a degree of flexibility and being chemically inert to the materials used in lamination of the layers during watercraft hull fabrication such that bonding to these layers by the insert does not occur. The insert 10 should also have a hardness value of less than about 90 Shore D but greater than about 65 Shore A when using lamination materials and a transom opening shape common for recreational power boats. In this range, it has been found that the insert 10 has sufficient dimensional stability when lamination layers of the hull are being applied around the sidewall 16 of the insert 10 to generate a structurally sound finished transom opening 102, but also has enough flexibility to be easily removed from within the opening 102 upon completion of watercraft hull 100 fabrication and to prevent unwanted movement of the gel coatings or other laminate coatings between the insert 10 and the molding tool 200, or between the insert 10 and lateral side edges 106 of the laminate layers forming the hull 100. If any heat curing is used during the lamination process of the hull layers, the insert 10 should also be configured to withstand this process without compromising the integrity thereof.

In another embodiment of the insert 10 semi-rigid body, a metal or other more rigid material (e.g., stiff composite) forms a central region 36 of the insert and the insert perimeter 17, including the sidewalls 16 and the perimeter lip 18, is formed of a less rigid material, such as a somewhat pliable composite like a polyurethane, a polyurea, or a polyurethane/polyurea compound or another substance that exhibits similar physical properties. This would aid in providing structural integrity to the insert 10 while ensuring that the sidewalls 16 and perimeter lip 18, which contact the laminate layers of the watercraft hull 100, remain flexible enough to facilitate the formation of a seal between the watercraft hull 100 and the insert 10.

In use, the molding tool 200 is formed with the surface 202 having a shape that will dictate the shape of the outer layer of the watercraft hull 100. A release agent is preferably first applied to the molding tool surface 202 to aid in the demolding of the insert 10 and watercraft hull 100 from the tool 200. The insert 10 is then positioned relative to the tool 200 to align the transom opening 102 on the finished watercraft hull 100. When the proper position is determined, the insert 10 is attached to the molding tool surface 202 at that location, and with the outboard surface 12 facing the transom of the tool 200 such that the perimeter lip 18 lies against the tool surface 202. Prior to lamination steps, the molding tool surface 202 and the inboard surface 14 and sidewall 16 of the insert 10 are preferably coated with a liquid gel coat that, upon curing, forms a semi-rigid film that forms the outer or "painted" surface 112 of the watercraft hull 100. This painted surface 112 is the mirror image of the shape of the molding tool surface 202 and is exposed upon demolding of the insert 100 and hull 100 from the molding tool 200. Then, various layers of laminate materials are applied in successive steps on top of one another and over the semi-rigid film layer around the sidewall 16 of the insert 10. The laminate materials typically include a fiber material in a liquid resin matrix that bonds to the semi-rigid film layer and forms a rigid layer upon curing that possesses the desired physical properties (e.g., strength, flexibility) for a watercraft hull. If the lamination process requires, additional actions (applying additional resins, coatings, or other materials, or heat curing) may be undertaken to ensure proper curing of the laminate layers. Additionally, various core layers, such as wood, foam, metals (e.g., aluminum) and the like, may be applied with the fiber and resin to build thickness and add strength to the laminate layers. Finally, upon curing, the insert 10 is detached from the molding tool 200 and the finished watercraft hull 100—having the insert 10 fit into the transom opening 102 thereof—is demolded from the tool surface 202. The insert 10 may then be removed towards the outboard direction of the hull 100 and away from the direction of taper thereof to reveal the finished hull having the transom opening 102 formed into the desired shape.

As can be seen, the insert 10 of the present invention for forming a transom opening in a watercraft hull provides a superior design to the aforementioned prior designs. The insert 10 can be formed in any number of shapes depending on the desired passageway geometry in a watercraft hull, and the durable and chemically inert nature of the design facilitates the repeated use of the insert in large run watercraft hull fabrication. Furthermore, since certain changes may be made in the above invention without departing from the scope hereof, it is intended that all matter contained in the above description or shown in the accompanying drawing be interpreted as illustrative and not in a limiting sense. It is also to be understood that the following claims are to cover certain generic and specific features described herein.

What is claimed is:

1. An insert for use in the fabrication of a watercraft hull to form an inboard/outboard propulsion system passageway by the hull being formed around the insert and subsequent removal of the insert from the hull to expose the passageway, comprising:

a semi-rigid body having a tapered sidewall with opposed sections and a base surface, and an perimeter lip formed at the intersection of the base surface and the sidewalls wherein the semi-rigid body is formed with one or more voids into which a tool may be inserted to facilitate manipulation of the position of the body with respect to watercraft hull to form the passageway.

2. The insert of claim 1, wherein the semi-rigid body is formed of a material selected from the group consisting of polyurea, polyurethane and a polyurea/polyurethane compound.

3. The insert of claim 1, wherein the tapered sidewall opposed sections comprise a first set of opposed tapered sections each having a base edge at the perimeter lip generally parallel with one another, and a second set of opposed tapered sections interconnecting the first set of opposed tapered sections.

4. The insert of claim 1, wherein the base surface comprises an outboard surface, and wherein the one or more voids comprise through-holes extending from the outboard surface of the semi-rigid body to an inboard surface of the semi-rigid body.

5. The insert of claim 1, wherein the tapered sidewall tapers continuously from the perimeter lip in a direction away from the base surface.

6. The insert of claim 1, wherein the semi-rigid body has a shore D hardness value of less than about 90.

7. The insert of claim 6, wherein the semi-rigid body has a shore A hardness value of greater than about 65.

8. An insert for use in the fabrication of a watercraft hull to form an inboard/outboard propulsion system passageway by the hull being formed around the insert and subsequent removal of the insert from the hull to expose the passageway, comprising:

a semi-rigid body having a tapered sidewall with opposed sections and a base surface, and an perimeter lip formed at the intersection of the base surface and the sidewalls wherein the semi-rigid body is formed of a more rigid material in a central region thereof and a less rigid material in a perimeter region thereof encompassing the tapered sidewall and the perimeter lip.

9. An insert configured to form an inboard/outboard propulsion system passageway in a boat hull, comprising a semi-rigid body having an inboard surface, an outboard surface, a sidewall spanning between the inboard and outboard surface and a perimeter lip extending from the intersection of the sidewall and the outboard surface, wherein the body has a shore D hardness value of less than about 90 and a shore A hardness value of greater than about 65.

10. The insert of claim 9, wherein the semi-rigid body is formed of a more rigid material in a central region thereof and a less rigid material in a perimeter region thereof encompassing the sidewall and the perimeter lip.

11. The insert of claim 9, wherein the semi-rigid body is formed with one or more through-holes extending from the inboard surface to the outboard surface and into which a tool may be inserted to facilitate manipulation of the position of the body with respect to hull to form the passageway.

12. A process for fabricating a watercraft hull with an inboard/outboard propulsion system passageway, comprising:

providing an insert as a semi-rigid body having an inboard surface, an outboard surface, and a sidewall spanning between the inboard and outboard surface;

attaching the insert to a surface of a molding tool, the surface configured to shape an outermost surface of the watercraft hull; applying a gel coat to the insert inboard surface and sidewall, and to the molding tool surface, the gel coat forming the outermost surface of the watercraft hull; applying one or more laminate layers over the outermost surface of the watercraft hull and around the sidewall of the insert;

curing the laminate layers to form a finished watercraft hull;

demolding the finished watercraft hull from the molding tool surface; and removing the insert from the watercraft hull to expose the inboard/outboard propulsion system passageway of the hull.

13. The process of claim 12, wherein the semi-rigid body is formed with one or more voids extending into the inboard surface into which a tool may be inserted to facilitate removal of the insert from the watercraft hull upon completion of the building of the material layers of the hull.

14. The process of claim 12, wherein the semi-rigid body is formed of a material selected from the group consisting of polyurea, polyurethane and a polyurea/polyurethane compound.

15. The process of claim 12, wherein the semi-rigid body is formed with a perimeter lip extending from the intersection of sidewall and the outboard surface.

16. The process of claim 15, wherein the sidewall tapers continuously from the perimeter lip towards the inboard surface.

17. The process of claim 15, wherein the semi-rigid body is formed of a more rigid material in a central region thereof and a less rigid material in a perimeter region thereof encompassing the sidewall and the perimeter lip.

18. The process of claim 12, further comprising the step of applying a release agent to the molding tool surface prior to attaching the insert thereto.

19. The process of claim 12, wherein the one or more laminate layers includes a fiber material in a liquid resin matrix and a core layer.

* * * * *